US010826232B2

(12) United States Patent
Atalay

(10) Patent No.: US 10,826,232 B2
(45) Date of Patent: Nov. 3, 2020

(54) CABLE CONNECTOR

(71) Applicant: NOVA ELEKTRIK SANAYI VE TICARET ANONIM SIRKETI, Istanbul (TR)

(72) Inventor: Suavi Atalay, Istanbul (TR)

(73) Assignee: NOVA ELECTRIK SANAYI VE TICARET ANONIM SIRKETI, Istanbul (TR)

( * ) Notice: Subject to any disclaimer, the term of this patent is extended or adjusted under 35 U.S.C. 154(b) by 0 days.

(21) Appl. No.: 16/494,442

(22) PCT Filed: Dec. 20, 2017

(86) PCT No.: PCT/TR2017/050690
§ 371 (c)(1),
(2) Date: Sep. 16, 2019

(87) PCT Pub. No.: WO2019/017859
PCT Pub. Date: Jan. 24, 2019

(65) Prior Publication Data

US 2020/0091653 A1 Mar. 19, 2020

(30) Foreign Application Priority Data

Apr. 10, 2017 (TR) ..... 2017/05300

(51) Int. Cl.
*H01R 13/627* (2006.01)
*H01R 13/639* (2006.01)
(Continued)

(52) U.S. Cl.
CPC ..... *H01R 13/6271* (2013.01); *H01R 13/639* (2013.01); *H01R 24/22* (2013.01);
(Continued)

(58) Field of Classification Search
CPC ..... H01R 13/627; H01R 13/6275; H01R 13/639; H01R 13/6392; H01R 24/22; H01R 24/30
See application file for complete search history.

(56) References Cited

U.S. PATENT DOCUMENTS 3,713,076 A * 1/1973 Gabrielian ..... H01R 13/627 439/352
10,050,380 B2 * 8/2018 Chevreau ..... H01R 13/6275
(Continued)

FOREIGN PATENT DOCUMENTS

DE 102011007763 A1 10/2012
JP 2011243323 A 12/2011
WO 2008102544 A1 8/2008

OTHER PUBLICATIONS

International Search Report for corresponding PCT/TR2017/050690.

*Primary Examiner* — Oscar C Jimenez
(74) *Attorney, Agent, or Firm* — Egbert, McDaniel & Swartz, PLLC

(57) ABSTRACT

A cable connector providing transmission of electric current from an electrical plug to an electrical device through an electric cable and a supply cable via electrical terminals upon achieving a contact of female terminals to male terminals and it is characterized in that it has at least one locking mechanism containing at least one female socket whereon male terminals are located, at least one male socket whereon female terminals are located and at least one tab providing interlocking of a female socket and a male socket and at least one resilient hook-whereon a tab is installed.

14 Claims, 3 Drawing Sheets

(51) Int. Cl.

| | |
|---|---|
| ***H01R 24/22*** | (2011.01) |
| ***H01R 24/30*** | (2011.01) |
| ***H01R 103/00*** | (2006.01) |
| ***H01R 105/00*** | (2006.01) |

(52) U.S. Cl.
CPC ..... *H01R 24/30* (2013.01); *H01R 2103/00* (2013.01); *H01R 2105/00* (2013.01)

(56) References Cited

U.S. PATENT DOCUMENTS

| | | | | |
|---|---|---|---|---|
| 10,404,012 | B1 * | 9/2019 | Stoyanov | H01R 13/6272 |
| 2011/0256750 | A1 * | 10/2011 | Chen | H01R 13/6273<br>439/345 |
| 2014/0242835 | A1 * | 8/2014 | Moran | H02G 3/083<br>439/528 |
| 2016/0118741 | A1 * | 4/2016 | Schmidt | H01R 13/44<br>439/131 |
| 2018/0316137 | A1 * | 11/2018 | Bozikis | H01R 13/639 |

* cited by examiner

CABLE CONNECTOR

THE RELATED ART

The invention relates to a cable connector.

The invention particularly relates to an electrical cable connector with lock which prevents involuntary electric supply interruption and can easily be mounted or detached manually even without viewing.

BACKGROUND OF THE INVENTION

Today electrical devices are used in all fields. Electrical energy and power supply cables carrying electricity are needed to operate electrical devices. Supply cables may have fixed connection to electrical devices like in most appliances or be removable like in computers. Removable supply cables may have a lock to secure the connection or be lockless.

Electrical connection in lockless connectors is usually carried out by connecting female terminals on the supply cable to male terminals on the electrical device. Such connections do not have any lock mechanisms. Male and female terminals may become disconnected when electrical device is moved or any involuntary external force such as hit or bump exerted on the connection. Such disconnection may result in complete electric supply interruption or if the connection becomes loose, an electric arc may be generated. Such involuntary disconnections may result in electrical device breakdown. Another impact of power supply interruption to electrical devices such as a fridge which is supposed to run permanently is that the electrical device going out of service without the user noticing it.

Supply connectors with lock have lock mechanisms which prevent involuntary disconnection of female and male terminals. Involuntary disconnection of electrical connectors does not happen unless intervened by the user. This ensures electrical devices stay securely connected to the mains supply. In current art, while connection of connectors can be made easily, dismantling of the connector from the device has to be made visually and/or by use of tools. Since mains connection to the appliance is usually at hard-to-access areas on the device, detachment of the connector may take time. In some applications, connection is even harder to detach and therefore connector may have to be damaged to detach it.

In emergency cases, when power supply has to be interrupted, looking for proper tools takes time or the connection may be damaged if proper tools are not used.

As a result, the need for an electric cable connector which prevents involuntary electric supply interruption that allows easy mounting and detachment even without viewing and insufficiency of current solutions have necessitated a development in the related art.

PURPOSE OF THE INVENTION

The present invention relates to a cable connector meeting the needs mentioned above, eliminating probable drawbacks and providing some additional advantages over other current solutions.

Main purpose of the cable connector disclosed under this invention is to provide easy mounting and detachment of the connection manually even with no visibility of connectors, meanwhile preventing involuntary electric supply interruption. Mounting and detachment of power supply cable can be made without using any tools, even not seeing the connection area and completely manually that exhibits an important advantage of use. This feature becomes important in places where electric outlet is difficult to access: for instance, user wishes to mount or detach a power connection easily where the power connection to the electrical device and the mains supply are accessible only by hand and not possible to see. Moreover, a lock mechanism located on the connector is designed to carry pull forces required for the safety of the connection which eliminates electrical device failures or risk of melted cable and fire due to electric arc.

For easier mounting and detachment, the locking element is designed in different color. This feature becomes important by increasing visibility to help the user, particularly in places where visibility is limited and/or the connection area is poorly lighted.

Another purpose of the invention is to mount and detach the connector without the need for any extra parts and/or tools. The cable connector consists of a female and a male socket. The female socket has male terminals on it whereas the male socket has female terminals on and electrical connection is realized by coupling of the male and the female terminals. Mechanical connection of these two parts of the assembly are realized by means of a tab located on the female socket and a resilient hook located on the male socket. The resilient hook goes into a guide channel on the female socket by flexing down and up and sits into the tab located on the upper surface of the channel. No additional part is needed for fixing the resilient hook into the housing. Since it is restricted from all 4 directions as it sits in the housing, it is fixed securely in place and therefore, no extra fixing component is needed. The top end of the resilient hook remains outside of the connection area after locking. When disconnection is required, this end extending beyond the locking area is manually pressed down and the lock is released.

In order to achieve the above mentioned purposes in best possible manner, a cable connector with a lock that prevents involuntary electricity supply interruption and allows easy mounting and detachment of the connection even without viewing is hereby developed. The developed cable connector consists of at least one female socket whereon male terminals are located, at least one male socket whereon female terminals are located, at least one resilient hook and at least one tab forming together at least one locking mechanism that enables interlocking of female and male sockets.

The structural features and characteristics of the invention and the advantages can be understood better in detailed descriptions with the figures given below and with the references to the figures, and therefore, the assessment should be made taking into account the said figures and the detailed explanations.

BRIEF DESCRIPTION OF THE DRAWINGS

In order to explain the structure and the advantages together with the additional components explicitly, the invention should be assessed with the figures that are explained hereinafter.

Figure 1:
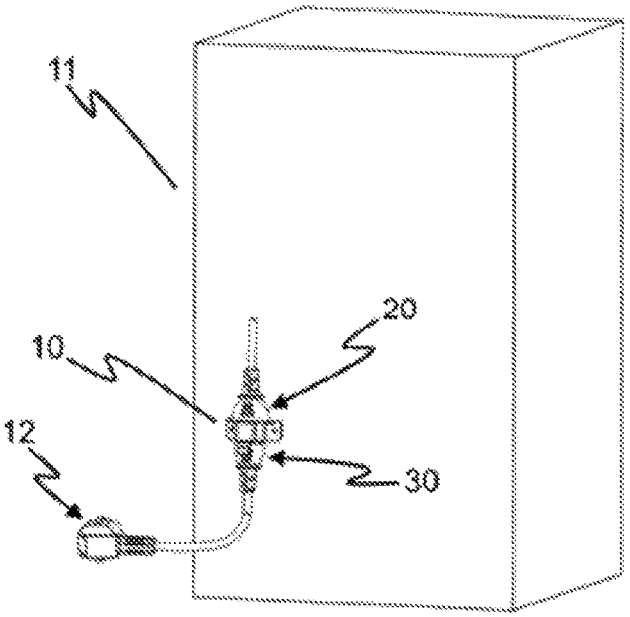
FIG. 1 is mounted view of the cable connector of the invention on the electrical device.

| Part References | |
|---|---|
| 10 | Cable connector |
| 11 | Electrical device |
| 12 | Electrical plug |
| 13 | Electric cable |
| 14 | Supply cable |
| 15 | Electrical terminal |
| 16 | Locking mechanism |
| 20 | Female socket |
| 21 | Connection bracket |
| 22 | Male terminal |
| 23 | Tab |
| 23a | Tab front surface |
| 23b | Tab rear surface |
| 24 | Guide channel |
| 30 | Male socket |
| 31 | Female terminal housing |
| 32 | Female terminal |
| 33 | Resilient hook housing |
| 33a | Housing side surface |
| 33b | Housing rear surface |
| 33c | Housing front surface |
| 40 | Resilient hook |
| 40a | Hook motion axis |
| 41 | Unlocking point |
| 42 | Tab cavity |
| 43 | Cavity rear surface |
| 44 | Cavity front surface |
| 45 | Rear compression surface |
| 46 | Side compression surface |
| 47 | Upper compression surface |
| 48 | Front compression surface |
| 49 | Cavity side surface |
| + | Plus direction |
| – | Minus direction |

DETAILED DESCRIPTION OF THE INVENTION

The cable connector (10), which is the subject of the invention explained here, is designed in such a manner to prevent involuntary electric supply interruption and in the meantime allows easy manual mounting and detachment even without observing. In order to achieve this aim, the cable connector (10) in the broadest meaning, consists of at least one female socket (20) whereon male terminals (22) are located, at least one male socket (30) whereon female terminals (32) are located and at least one locking mechanism (16) having at least one tab (23) and at least one resilient hook (40) inserted in the tab (23) to provide interlocking of the female socket (20) and the male socket (30)

Figure 2:
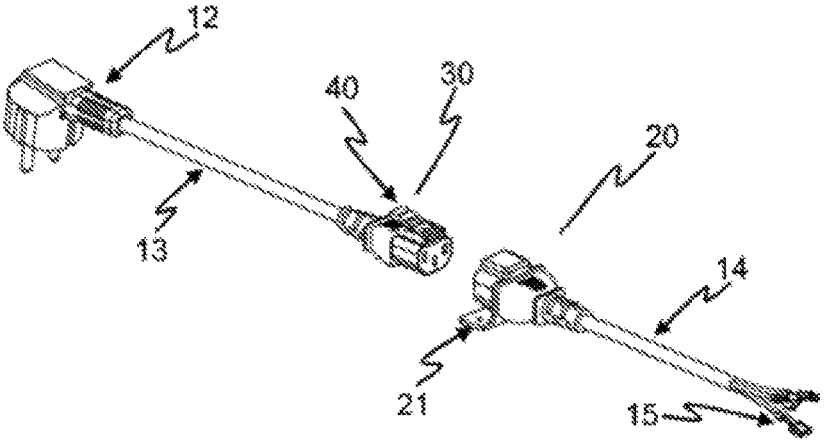
FIG. 2 is perspective view of the cable connector of the invention.

FIGS. 1 and 2 show mounted view of the cable connector (10) on the electrical device (11) and perspective view of the cable connector (10) respectively. The female socket (20) is fixed on the electrical device (11) mechanically by means of the connection bracket (21) and electrically by means of the electrical terminals (15). After connection to the electrical device (11), the female terminals (32) located on the male socket (30) and the male terminals (22) located on the female socket (20) are interconnected and electric current supplied from the electrical plug (12) is transmitted to the electrical device (11) through the electric cable (13), the supply cable (14) and the electrical terminals (15). The female socket (20) is designed to be mounted on the electrical device (11) in fixed manner whereas the male socket (30) is designed to be removable. The male socket (30) supplies electricity from mains by means of the electrical plug (12) connected to it. Electrical connection is provided by interconnection of the male socket (30) and the female socket (20).

Figure 3:
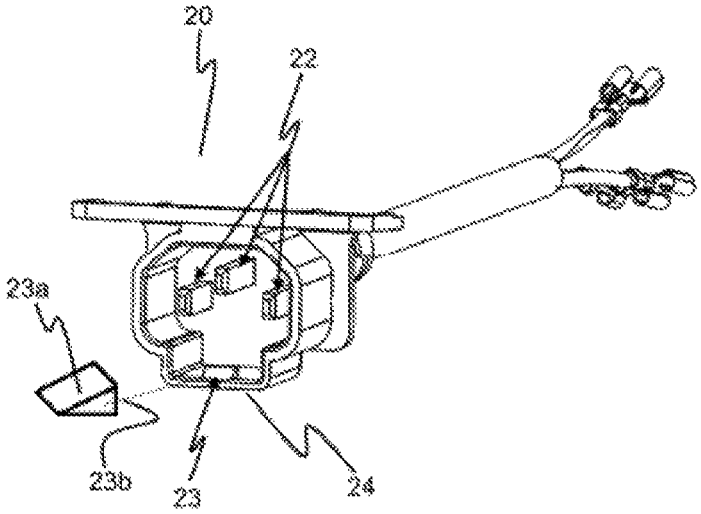
FIG. 3 is perspective view of the female socket on the cable connector of the invention disclosed hereunder.

FIG. 3 shows exploded view of the female socket (20) located on the cable connector (10) of the invention disclosed hereunder. The supply cable (14) connected to the female socket (20) has common electrical terminals (15) to provide connection to the electrical device (11). The said electrical terminals (15) can be in various sizes and forms in order to be compatible with the connections in the electrical device (11). The female socket (20) has a connection bracket (21) so as to fix it onto the electrical device (11). The tab (23) located on the female socket is structurally in triangle form. The tab front surface (23*a*) has a slope so as to fit into the tab cavity (42) in the locking mechanism (16). The tab rear surface (23*b*) is preferably designed in perpendicular form to prevent involuntary disconnection from the tab cavity (42) while in locked status. The guide channel (24) located on the female socket (20) is in the size and form to tightly surround the resilient hook (40) and the resilient hook housing (33). Thus, contact of the female terminals (32) to the male terminals (22) in a position other than intended is prevented and only proper contact is ensured at all times. The female socket (20) is connected to the male terminals (22) mechanically and electrically. The female socket (20), together with all its components is integrated using plastic moulding method to insulate both electrically and against other external effects.

Figure 4:
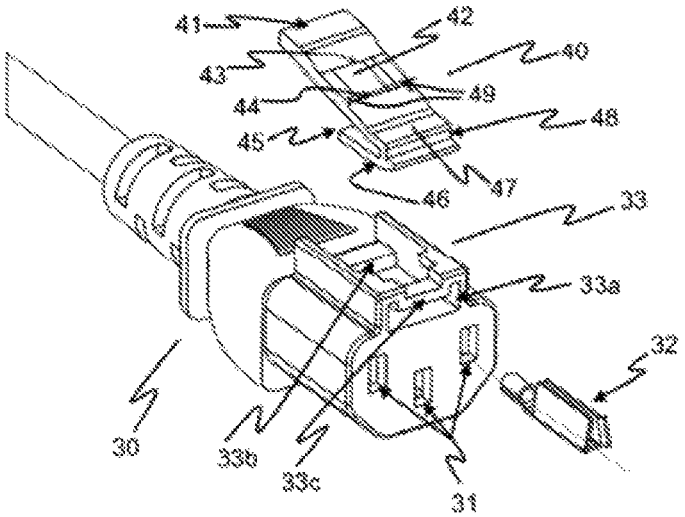
FIG. 4 is exploded view of male socket on the cable connector of the invention disclosed hereunder.

FIG. 4 shows exploded view of the male socket (30) provided on the cable connector (10) in the invention disclosed hereunder. The locking mechanism (16) contains a resilient hook (40) located on the male socket (30) and a resilient hook housing (33). The resilient hook (40) consists of a tab cavity (42) where the tab (23) located on the female socket (20) can be inserted in, a cavity front surface (44) limiting backward movement of the tab cavity (42), a cavity rear surface (43) located on the opposite side and cavity side surfaces (49). Thanks to this structure, after the tab (23) is inserted in the resilient hook (40), disconnection of the male terminals (22) and the female terminals (32) due to involuntary movements is prevented. Deactivation of the locking mechanism (16), whenever desired, which disconnects the male socket (30) from the female socket (20) can be achieved by pressing the unlocking point (41) located on the resilient hook (40) that moves the resilient hook in plus direction (+) or minus direction (–). When a force is applied onto the unlocking point (41) in minus direction (–), the tab (23) is released from the tab cavity (42) and this enables disconnection of the male socket (30) from the female socket (20). When the force applied on the unlocking point in minus direction (–) is removed, the resilient hook (40) moves in plus direction (+) and takes its initial position.

All components, other than the resilient hook (40), forming the male socket (30) are integrated mechanically by means of plastic moulding method. The resilient hook (40) is produced separately and mounted into the resilient hook housing (33) after plastic moulding process. The rear compression surface (45), the side compression surface (46), the upper compression surface (47) and the front compression surface (48) on the resilient hook (40) enables fixing of the resilient hook (40) into the resilient hook housing (33). The rear compression surface (45) on the resilient hook (40) rests against the housing rear surface (33*b*); the side compression surface (46) against the housing side surface (33*a*); the upper compression surface (47) and the front compression surface (48) against the housing front surface (33*c*); therefore the resilient hook (40) in the resilient hook gripper housing (33) is constricted in all four directions.

The resilient hook (40) and the tab (23) are designed in such manner to carry the pull forces required for safety between the male socket (30) and the female socket (20). Thus disconnection of the male terminals (22) from the female terminals (32) due to external forces that may be applied onto the cable connector (10) involuntarily is prevented.

The resilient hook (40) has preferably different colour than of the male socket (30) and the female socket (20). Particularly, in places where visibility is limited and/or the area the cable connector (10) located has little light, different colour of the resilient hook (40) increases noticeability and facilitates mounting and detaching of the cable connector (10).

Figure 5:
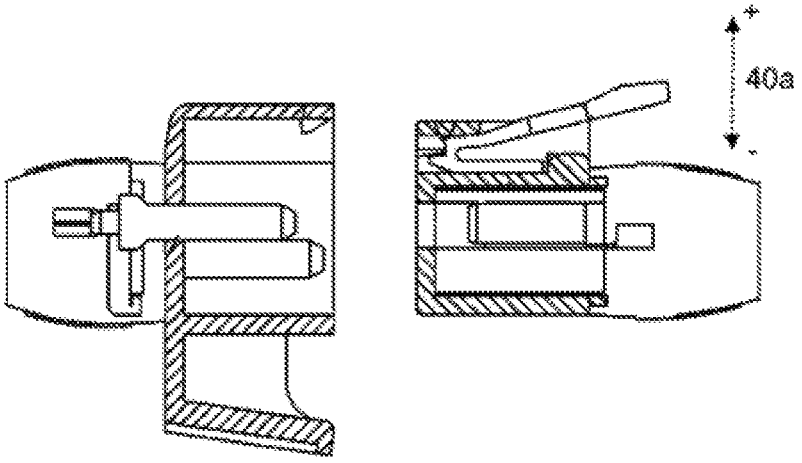
FIG. 5 is cross-sectional view of the cable connector of the invention in non-connected status.
Figure 6:
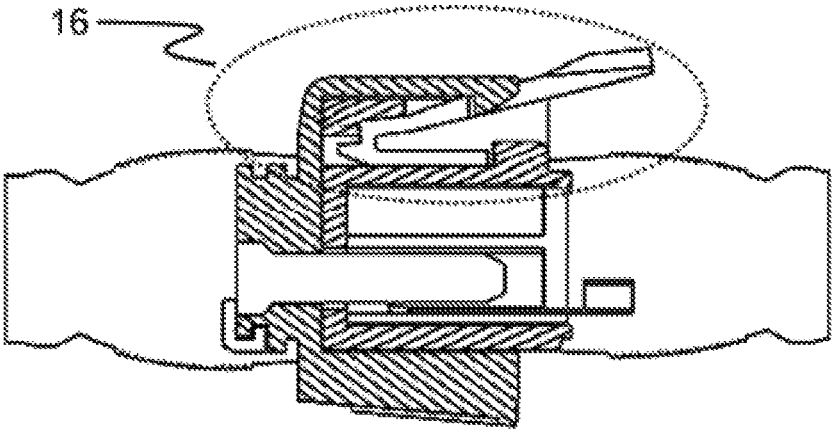
FIG. 6 is cross-sectional view of the cable connector of the invention in connected status.

FIG. 5 and FIG. 6 show cross section views of the cable connector (10) of the invention respectively in unconnected and connected situations. While the male terminals (32) and the female terminals (22) provide electrical connection, two components of the locking system (16), namely, the tab (23) and the resilient hook (40) provide mechanical connection. The resilient hook (40) is made of a flexible plastic material and designed in such a way to flex easily in plus (+) and minus (−) directions on the hook motion axis (40*a*). During connection of the male socket (30) to the female socket (20), the tab front surface (23*a*) gets in touch with the resilient hook (40) and moves the resilient hook (40) in minus direction (−) with surface pressure and the tab (23) fully enters in the tab cavity (42) as a result of axial motion, and the resilient hook (40) moves back in plus direction (+) under spring effect and traps the tab (23) in the tab cavity (42). During this procedure, the resilient hook housing (33) and the resilient hook (40) fit completely into the guide channel (24). Thus locking of the male socket (30) and the female socket (20) is achieved. After locking, the tab rear surface (23*b*) and the cavity front surface (44) are positioned across each other and resist the extraction force.

A push force is applied onto the unlocking point (41) in minus direction (−) in order to deactivate the locking mechanism (16). The male socket (30) may disconnect from the female socket (20) after the cavity front surface (44) moves in minus direction (−) on the hook motion axis (40*a*) and goes below the tab rear surface (23*b*) level. Thus the male terminals (22) move out of the female terminal housing (31) and become disconnected with the female terminals (32) and both electrical and mechanical disconnections are achieved.

The invention claimed is:

1. A cable connector for transmitting electrical current from an electrical plug through an electrical cable and a supply cable, the cable connector comprising:

at least one female socket having male terminals thereon;

at least one male socket having female terminals thereon;

a locking mechanism having at least one tab and at least one resilient hook, the at least one tab being lockable in the at least one resilient hook such that said at least one female socket is interlocked with said at least one male socket; and at least one resilient hook housing formed on said at least one male socket, the at least one resilient hook being seated and secured in said at least one resilient hook housing, said at least one resilient hook housing comprising:

at least one housing rear surface contacting a rear compression surface of the at least one resilient hook so as to provide rear compression thereto;

at least one housing side surface contacting a side compression surface of the at least one resilient hook so as to provide side compression thereto; and at least one front surface contacting an upper compression surface of the at least one resilient hook so as to provide front and upper compression thereto.

2. The cable connector of claim 1, wherein the at least one tab is positioned on said at least one female socket, the at least one resilient hook being positioned on said at least one male socket.

3. The cable connector of claim 1, wherein the at least one tab has at least one inclined front surface.

4. The cable connector of claim 1, wherein the at least one tab has at least one rear surface so as to prevent rearward movement of the at least one resilient hook.

5. The cable connector of claim 1, wherein at least one female socket having at least one guide channel formed thereon, said at least one resilient hook being insertable into the at least one guide channel.

6. The cable connector of claim 1, wherein at least one resilient hook has at least one unlocking point formed thereon so as to allow movement of the at least one resilient hook on a hook motion axis when the at least one unlocking point is pressed.

7. The cable connector of claim 1, wherein at least one resilient hook has at least one cavity formed thereon, the at least one tab being seated in the at least one cavity.

8. The cable connector of claim 7, wherein at least one cavity has at least one cavity side surface formed on opposite sides thereof so as to prevent lateral movement of the at least one resilient hook when the at least one tab is seated in the at least one tab cavity.

9. The cable connector of claim 7, wherein the at least one cavity rear surface on an upper portion thereof so as to allow a complete seating of the at least one tab in the at least one cavity.

10. The cable connector of claim 7, wherein the at least one cavity has a cavity front surface on an upper portion thereof so as to prevent rearward movement of the at least one resilient hook.

11. The cable connector of claim 1, further comprising:

a plurality of female terminal housing of an identical number of the female terminals on said at least one male socket and located on a geometric axis identical to a geometric axis of the male terminals.

12. The cable connector of claim 1, further comprising:

at least one connection bracket formed on said at least one female socket.

13. The cable connector of claim 1, wherein the at least one resilient hook is of a color different than a color of said at least one male socket and different than a color of said at least one female socket.

14. The cable connector of claim 1, wherein the at least one resilient hook is formed of a resilient material.

* * * * *